US007417658B2

(12) United States Patent
Montagutelli

(10) Patent No.: US 7,417,658 B2
(45) Date of Patent: Aug. 26, 2008

(54) THERMAL PRINTING MECHANISM, IN PARTICULARLY APPLICABLE TO PAYMENT TERMINALS

(75) Inventor: Denis Montagutelli, Angers (FR)

(73) Assignee: APS Engineering, Paris (FR)

( * ) Notice: Subject to any disclaimer, the term of this patent is extended or adjusted under 35 U.S.C. 154(b) by 169 days.

(21) Appl. No.: 10/508,519

(22) PCT Filed: Mar. 19, 2003

(86) PCT No.: PCT/FR03/00874

§ 371 (c)(1),
(2), (4) Date: Jun. 20, 2005

(87) PCT Pub. No.: WO03/080347

PCT Pub. Date: Oct. 2, 2003

(65) Prior Publication Data

US 2006/0176360 A1 Aug. 10, 2006

(30) Foreign Application Priority Data

Mar. 21, 2002 (FR) ..... 02 03504

(51) Int. Cl.
*B41J 2/32* (2006.01)
*B41J 29/02* (2006.01)
*B41J 29/377* (2006.01)

(52) U.S. Cl. ..... 347/222; 347/171; 347/197; 347/215; 400/120.01; 400/120.16; 400/208

(58) Field of Classification Search ..... 400/120.16, 400/120.01, 208; 347/171, 215, 222
See application file for complete search history.

(56) References Cited

U.S. PATENT DOCUMENTS 4,475,825 A * 10/1984 Hashimoto ..... 400/120.01

(Continued)

FOREIGN PATENT DOCUMENTS

JP 08039890 A * 2/1996

(Continued)

OTHER PUBLICATIONS

American Psychological Association (APA): weld. (n.d.). Dictionary.com Unabridged (v 1.1). Retrieved Apr. 4, 2007, from Dictionary.com website: http://dictionary.reference.com/browse/weld.*

(Continued)

*Primary Examiner*—Matthew Luu
*Assistant Examiner*—John P Zimmermann
(74) *Attorney, Agent, or Firm*—Westerman, Hattori, Daniels & Adrian, LLP.

(57) ABSTRACT

A thermal printing mechanism comprises a frame accommodating a motor for driving a print tape, a thermal printing head, a carrying roller and electronic control means. The frame is provided with a metal stiffening plate substantially extending along the length thereof, acting as a support for the motor, on which plate it is fixed by means of welding in order to form means for dissipating the heat. Said plate is also used as a support for pushing the spring for the printing head towards the carrying roller. The mechanism is electronically controlled by means of a flexible connector which is connected to remote control means for said mechanism and which is used to evacuate electrostatic charges.

16 Claims, 3 Drawing Sheets

U.S. PATENT DOCUMENTS

| | | | | | |
|---|---|---|---|---|---|
| 4,911,567 | A | * | 3/1990 | Fujihira | 400/120.16 |
| 4,921,363 | A | * | 5/1990 | Nishihara et al. | 400/120.16 |
| 5,026,185 | A | | 6/1991 | Kusabuka | |
| 5,055,858 | A | * | 10/1991 | Koch | 347/197 |
| 5,304,007 | A | * | 4/1994 | Flanagan | 400/120.16 |
| 5,366,302 | A | * | 11/1994 | Masumura et al. | 400/120.16 |
| RE35,026 | E | * | 8/1995 | Mahoney | 400/120.17 |
| 5,528,278 | A | * | 6/1996 | Takizawa et al. | 347/218 |
| 5,680,169 | A | * | 10/1997 | Bae | 347/197 |
| 5,746,520 | A | * | 5/1998 | Kohira | 400/120.01 |
| 5,846,003 | A | * | 12/1998 | Mori et al. | 400/120.17 |
| 5,904,429 | A | * | 5/1999 | Goodwin et al. | 400/693 |
| 6,203,224 | B1 | | 3/2001 | Kerr | |
| 6,217,240 | B1 | * | 4/2001 | Lee | 400/120.16 |
| 6,276,848 | B1 | * | 8/2001 | Takizawa et al. | 400/120.01 |
| 6,338,584 | B1 | | 1/2002 | Montagutelli | |
| 6,480,216 | B2 | * | 11/2002 | Ando | 347/197 |
| 6,538,680 | B2 | * | 3/2003 | Sato | 347/197 |
| 6,682,239 | B2 | * | 1/2004 | Mori et al. | 400/649 |
| 6,812,943 | B1 | * | 11/2004 | Day et al. | 347/171 |
| 7,002,611 | B2 | * | 2/2006 | Mori et al. | 347/215 |

FOREIGN PATENT DOCUMENTS

| | | | |
|---|---|---|---|
| JP | 08332752 | A * | 12/1996 |
| JP | 10119327 | A * | 5/1998 |
| JP | 10258532 | A * | 9/1998 |

OTHER PUBLICATIONS

Chicago Manual Style (CMS): weld. Dictionary.com. Dictionary.com Unabridged (v 1.1). Random House, Inc. http://dictionary.reference.com/browse/weld (accessed: Apr. 4, 2007).*

Modern Language Association (MLA): "weld." Dictionary.com Unabridged (v 1.1). Random House, Inc. Apr. 4, 2007. <Dictionary.com http://dictionary.reference.com/browse/weld>.*

JP 08332752 Machine Translation : http://www4.ipdl.inpit.go.jp/Tokujitu/tsogodbenk.ipdl.*

JP 10258532 Machine Translation : http://www4.ipdl.inpit.go.jp/Tokujitu/tjsogodbenk.ipdl.*

JP 10119327 Machine Translation : http://www4.ipdl.inpit.go.jp/Tokujitu/tjsogodbenk.ipdl.*

JP 08039890 Machine Translation : http://www4.ipdl.inpit.go.jp/Tokujitu/tjsogodbenk.ipdl.*

JP 08332752 Machine Translation : http://www4.ipdl.inpit.go.jp/Tokujitu/tjsogodbenk.ipdl (Dec. 1996).*

JP 10258532 Machine Translation : http:www4.ipdl.inpit.go.jp/Tokujitu/tjsogodbenk.ipdl (Sep. 1998).*

JP 10119327 Machine Translation : http://www4.ipdl.inpit.go.jp/Tokujitu/tjsogodbenk.ipdl (May 1998).*

JP 08039890 Machine Translation: http://www4.ipdl.inpit.go.jp/Tokujitu/tjsogodbenk.ipdl (Feb. 1996).*

* cited by examiner

THERMAL PRINTING MECHANISM, IN PARTICULARLY APPLICABLE TO PAYMENT TERMINALS

The invention relates to the field of thermal printing machines. An object of the invention is to provide a thermal printing mechanism notably applicable to payment terminals. The object of the invention is more particularly a chassis structure which is part of such mechanism.

Thermal printing mechanisms are known, comprising a chassis housing mainly a printable tape driving means, a thermal printing head, means for contacting the tape against the printing head, and electronic means for controlling and driving the dynamic members of the mechanisms. The tape driving means comprise a motor for driving the reserve of a roll of tape. The tape circulates between the printing head and a support roller, the latter being driven into rotation by the motor, via a gear train, for example. The means for contacting the tape against the printing head comprise currently an elastic member for pushing the printing head towards the support roller.

It should be noted at this stage of the description that a simple structure is sought for this type of mechanism, offering the possibility of making it consumable, in order to facilitate the maintenance of the printing machines to which it is applied, notably in the case of payment terminals. This structure simplification aims more particularly at limiting the constitutive elements as well as the assembly operations of the different members to one another. This structure simplicity also aims essentially at making the mechanisms as compact as possible, for obvious reasons of reduced space requirements.

It will be understood that the present invention is in keeping with this framework of constraints, and with the design difficulties deriving therefrom.

An ancient prior art has suggested printing mechanisms essentially composed of metal elements, notably the chassis. Assembling the elements together involves the use of fastening members, with a consequent increase in the assembly operations, and inappropriately high production cost in view of the compact and consumable properties desired for this type of mechanism.

A more recent prior art has suggested chassis made of plastic material, making it possible to meet these requirements easily, the chassis being adapted to be obtained by moulding.

A problem that occurs when a chassis is made of plastic material is its fragility. Indeed, this type of chassis usually comprises a couple of strut-braced spaced lateral walls, which support the functional members of the mechanism. This fragility results notably from a flexibility of the lateral walls, which alters the ability to maintain them at constant distance from one another. Therefore, it has been suggested, with a view at rigidifying the chassis, to equip it with a rigidification plate extending substantially over its length. This plate is interconnected and immobilised on the chassis between the lateral walls, in translation as well as in rotation about its own axis.

One may also refer to the patent EP0969970 (APS ENGINEERING), which describes such a mechanism. It should be noted that according to this prior art, close to that of the invention examined, with respect to its structure as well as with respect to the general problems to be solved, this rigidification plate is advantageously used as a support for the electronic means intended for controlling and driving the dynamic members of the mechanism.

Besides, a problem to be solved for the thermal printing mechanisms lies in the heat sinking effect generated by the motor and in the presence of detrimental electrostatic charges. In this respect, the use of chassis made of plastic material is ill-suited to the resolution of such problems, as it involves specific arrangements to solve these problems, to the detriment of the simplicity of the mechanism.

The aim of the present invention is to provide a thermal printing mechanism, and more particularly a chassis structure which is part of this mechanism, which offers a satisfactory compromise between solutions applied to the problems that occur usually for these mechanisms and that have been mentioned above.

The invention aims notably at providing such a mechanism which is as compact as possible, while being simple in its structure so as to reduce its production cost, during manufacturing as well as during assembly, which is robust, and which has optimised faculties with respect to heat sinking and evacuation of the electrostatic charges. The present invention provides more particularly a chassis supporting the functional members which are part of such a mechanism.

The inventive approach of the present invention consisted, in a first step, in reducing the volume of the motor member, which is decisive for the space requirements of the mechanism. For exemplification purposes, this reduction in the motor member is obtained by reducing its diameter, to bring this diameter back to a size ranging between 15 and 20% of the width of the printing mechanism, rather than in the order of 25% of that width as was usually the case according to the prior art.

Then, there is the problem of the heat generated by the motor member, which is all the more important as its diameter is reduced. The inventive approach of the present invention consisted, in a second step, in exploiting the rigidification plate of the chassis to which it is immobilised, in order to form a supporting bracket for the motor to which it is fixed via heat exchanging means. These heat exchanging means are advantageously simple welding fastening means. The rigidification plate, selected as a metal plate, forms, thanks to these arrangements, means for sinking the heat generated by the motor.

As a result of these arrangements, the general space requirements of the printing mechanism are reduced considerably as compared to those of the prior art, thanks to the reduction in diameter of the motor and to its fastening, notably by welding, to the rigidification plate.

Another result of these arrangements is that these reduced space requirements do not affect the sensitive members of the mechanism through a detrimental increase in the heat caused by the motor, thanks to the exploitation of the rigidification plate as a heat sinking member for said heat.

Still another result is a simplified structure of the mechanism, whereas the rigidification plate may be added to the chassis, notably by fitting, after having been linked to the motor by welding, an operation performed advantageously in a remote workshop. Finally, since the rigidification plate is operated as a heat sinking member, these arrangements make it possible to avoid equipping the chassis with additional elements specifically intended for that purpose.

Besides, such arrangements make it possible to simplify the overall carrying structure of the mechanism, notably the chassis cross-braced by the plate, by offering a rigidification plate which is by itself part of the motor member, and more particularly of the cylindrical body housing its functional members. More precisely, the rigidification plate comprises an end wing, oriented transversally to its general extension, which forms a wall closing the cylindrical body of the motor member to which it is welded.

Building upon the initial inventive approach of the present invention, it is advantageously proposed to exploit moreover the rigidification plate, firstly, to form a supporting bracket of the elastic member pushing the printing head towards the support roller.

Secondly, as the electronic controlling and driving means may not be supported by the rigidification plate by reason of the latter's heat sinking function, the rigidification plate comprises, preferably transversally, a longitudinal window for letting through a flexible connector, which is part of the electronic controlling means, in order to link the dynamic members of the mechanism to the remote electronic controlling means.

More precisely, regarding the arrangements relating to the elastic member, according to another aspect of the invention, said elastic member includes at least one leaf spring equipped with fastening means to the rigidification plate.

These arrangements are such that, in addition to the simplified structure of the mechanism obtained, the push exerted onto the printing head towards the support roller is rendered homogeneous and reliable, whereas the leaf spring may advantageously extend, in an equivalent manner, continuously or discontinuously, over almost the whole length of the width of the mechanism, to adopt distant longitudinal bearing points against the printing head.

The fastening means of the leaf spring to the rigidification plate are advantageously formed by lateral rails provided on the spring, inside which are inserted jointly the corresponding longitudinal edges of the rigidification plate. These arrangements are such that the leaf spring is connected to the rigidification plate by a sliding and fitting process. It should also be noted that the rigidification plate extends preferably, not only over the length of the chassis, but also over its width, in order, on the one hand, to provide a proper seat for the elastic member pushing the printing head towards the support roller, and on the other hand, to promote the rigidification of the chassis by cross-bracing both its lateral walls over the major portion of its depth.

Besides, the link between the elastic member and the rigidification plate is advantageously operated by using this elastic member as a locking means, for immobilising the rigidification plate on the chassis. To this effect, the elastic member comprises an elastic fitting spoiler co-operating with a corresponding relief of the chassis. These arrangements are such that the placement of the rigidification plate, carrying the elastic member, causes flexion of the spoiler against its natural position until it is inserted against the corresponding relief of the chassis. This relief forms a stop against the return of the spoiler to its natural position, in order to oppose the spontaneous, or possibly voluntary, retraction of the rigidification plate.

More precisely still, and by reference to another aspect of the invention, an arrangement of the electronic controlling means is selected that includes the aforementioned flexible connector, which extends across the window provided in the rigidification plate.

There also derives, not only the preservation of the electronic controlling means of the heat generated by the motor, but also a gain in the space requirements of the mechanism. This gain in space requirements is obtained more particularly by moving the electronic controlling means away beyond the printing mechanism, notably on the chassis of the printing machine.

The use of a flexible connector for the transmission of the driving information makes it possible, not only to enable this remote placement, but also to free the inner volume of the chassis, in order to make it available for the reception of the other members of the mechanisms and/or to reduce said volume, so as to reduce accordingly the global space requirements of the mechanism.

According to another aspect of the present invention, the chassis is preferably obtained by moulding a plastic material, thereby simplifying its manufacture, and comprises reliefs for the fitting and fastening process, on the one hand, on the side of the motor member and the ends of the support roller and of the printing head, and on the other hand, of the rigidification plate.

Thanks to the arrangements of the invention, this construction of the chassis in a plastic material does not prevent, however, another aspect of the invention, which lies in grounding the members of the mechanism liable to transport electrostatic charges. Indeed, the printing head often comprises a supporting bracket for a metal head whereon is deposited a ceramic substrate. Besides, the mechanism is preferably equipped with a metal paper guide, advantageously formed by cutting/folding a metal plate. As a result, all the metal members of the mechanism are in electrostatic contact one after the other, notably starting from the paper guide, the printing head, the support roller via the paper, the elastic pushing member, the rigidification plate, and the motor member. The flexible connector, according to another aspect of its use, is advantageously applied to transport these electrostatic charges towards a reference potential, placed beyond the mechanism and notably towards the electronic controlling means supported by the machine.

It will be noted finally that the arrangements which have just been described should be taken into consideration, individually as well as in combination, as regards the results obtained pertaining to each of these arrangements or to their combinations.

The present invention will be better understood and relevant details thereof will appear in the following description of a preferred embodiment, in relation with the figures on the appended drawings, wherein.

Figure 5:
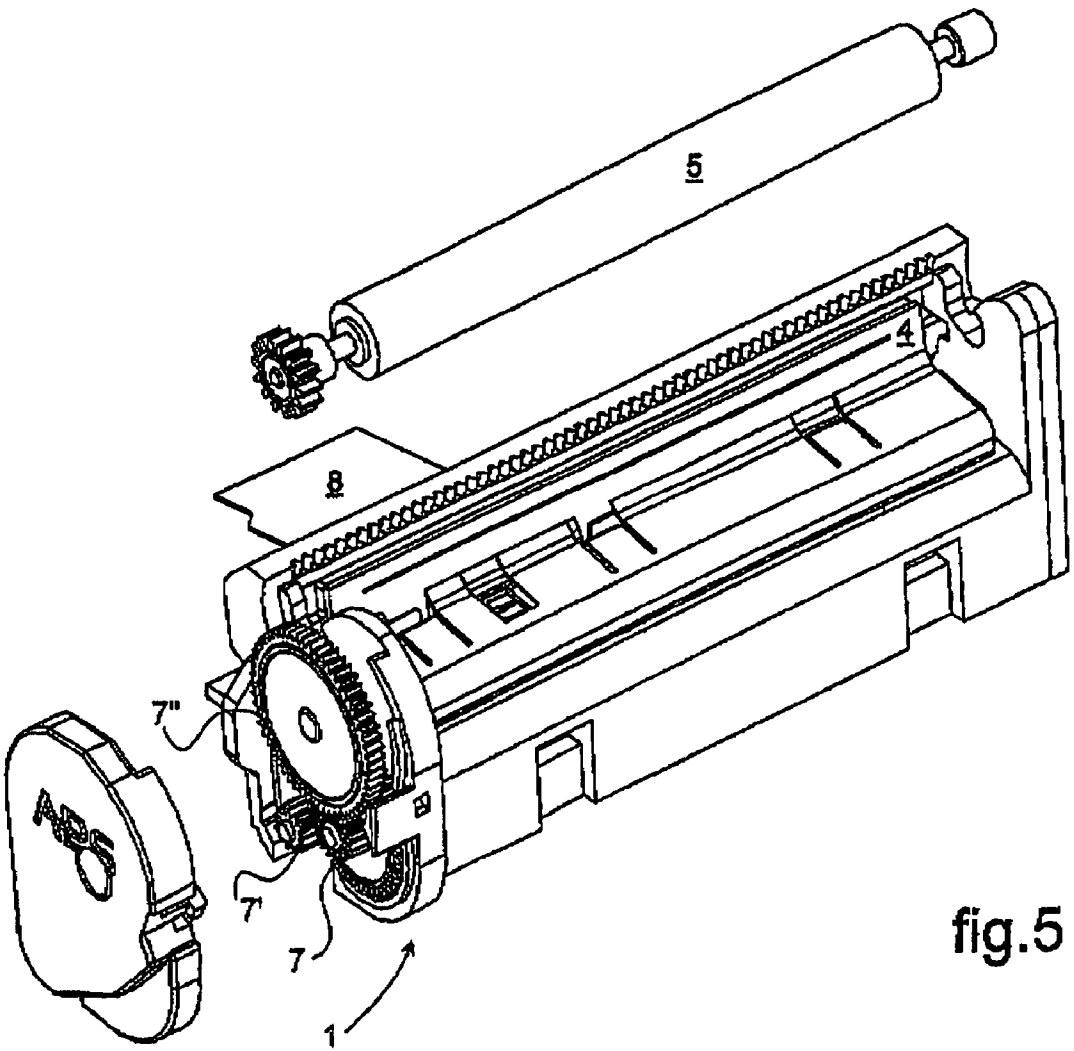
FIG. 5 is a perspective partially exploded view of the mechanism represented on FIG. 1.

On the figures, a thermal printing mechanism comprises mainly:

a) A chassis 1 carrying the functional members of the mechanism.

b) A thermal printing head 4, particularly visible on FIG. 5.

c) A support roller 5 against which abuts the printable tape via the printing head 4. It will be noted that this tape, the reserve roll of which is supported by a printing machine equipped with the mechanism of the invention, is not represented on the Figures.

d) A motor 6 for driving the printable tape via the support roller 5, which it drives into rotation by means of a gear train 7, 7', 7". It will be noted that the displacement of the tape results from the rotation of the support roller 5 and from the elastic pinching of the tape between the support roller 5 and the printing head 4.

e) A flexible connector 8 for driving the dynamic members of the mechanism, and notably the implementation of the motor 6 driving the support roller 5 and thermal means of the printing head 4.

Reliefs are provided in the chassis 1, by moulding reserves, for fitting-fastening of the motor 6, of the support roller 5, of the printing head 4 and of a rigidification plate 9. The latter 9 extends over almost both dimensions of the chassis, and supports the motor member 6.

A leaf spring 10 is inserted by sliding on the rigidification plate 9, to which it is fixed by fitting using lateral rails 11 and 12 with which it is equipped. These rails co-operate with the external longitudinal edges 13 and 14 of the rigidification plate 9. This spring 10 is intended for exerting an elastic push against the printing head 4, towards the support roller 5 for pinching therebetween the printable tape. There will also be noted an elastic spoiler 2 making it possible to lock the immobilisation of the rigidification plate 9 on the chassis 1. This spoiler 2 co-operates to this end with a stop relief provided on the chassis during moulding, not visible on the Figures.

Finally, the rigidification plate 9 comprises, crosswise, a window 15 for letting through the flexible connector 8.

Figure 1:
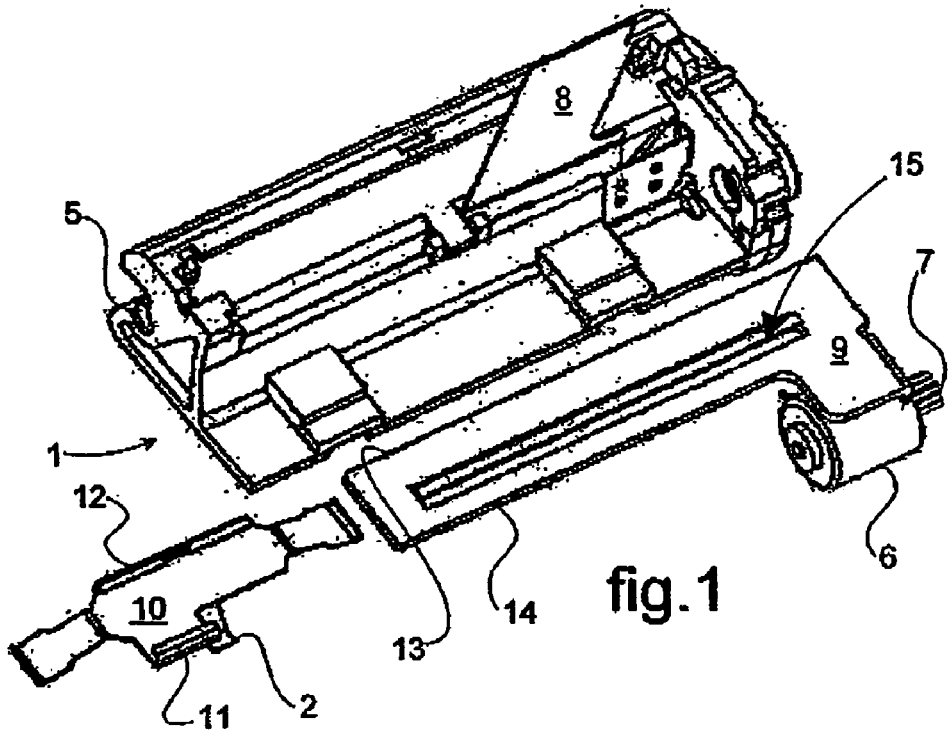
FIG. 1 is an exploded partial view of a thermal printing mechanism according to a preferred embodiment of the invention.
Figure 2:
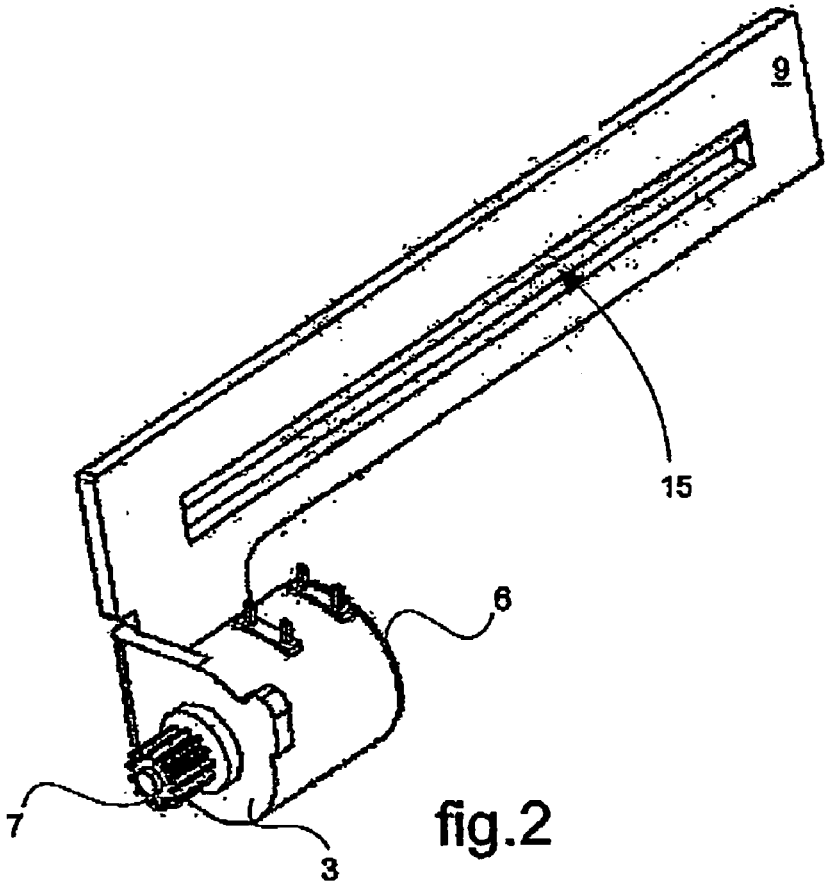
FIG. 2 is a perspective view illustrating a rigidification plate supporting a motor, which is part of the device represented on the previous figure.
Figure 3:
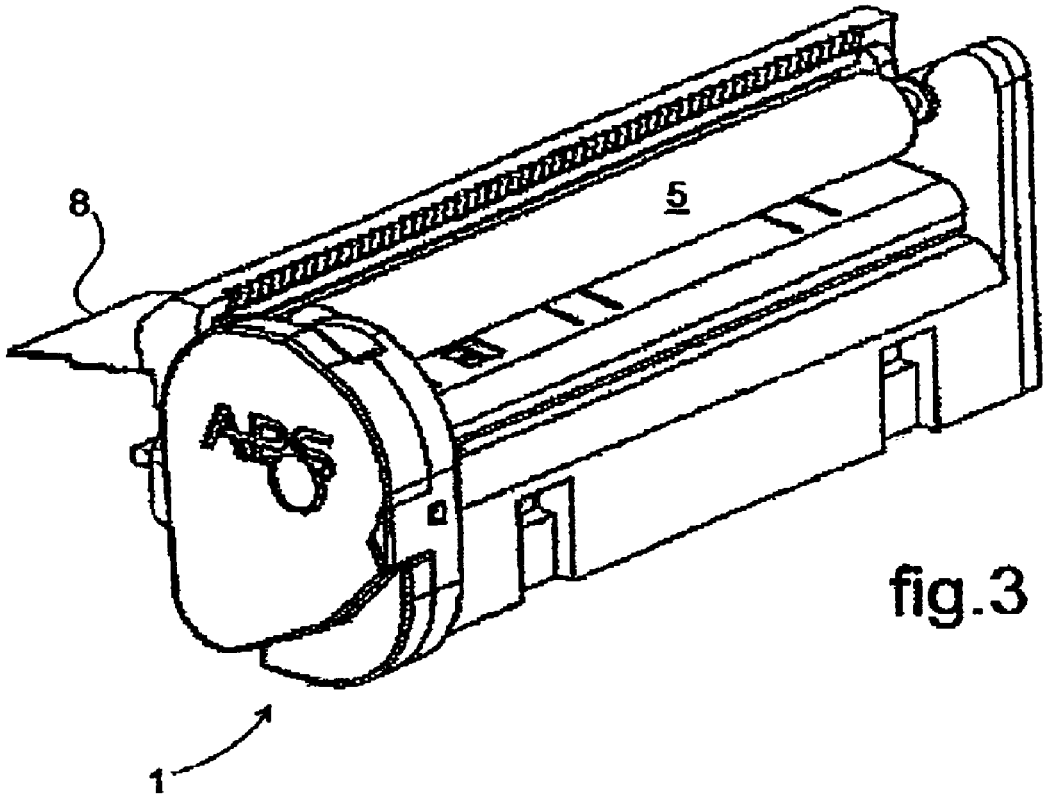
FIG. 3 is a perspective view of the mechanism represented on FIG. 1.
Figure 4:
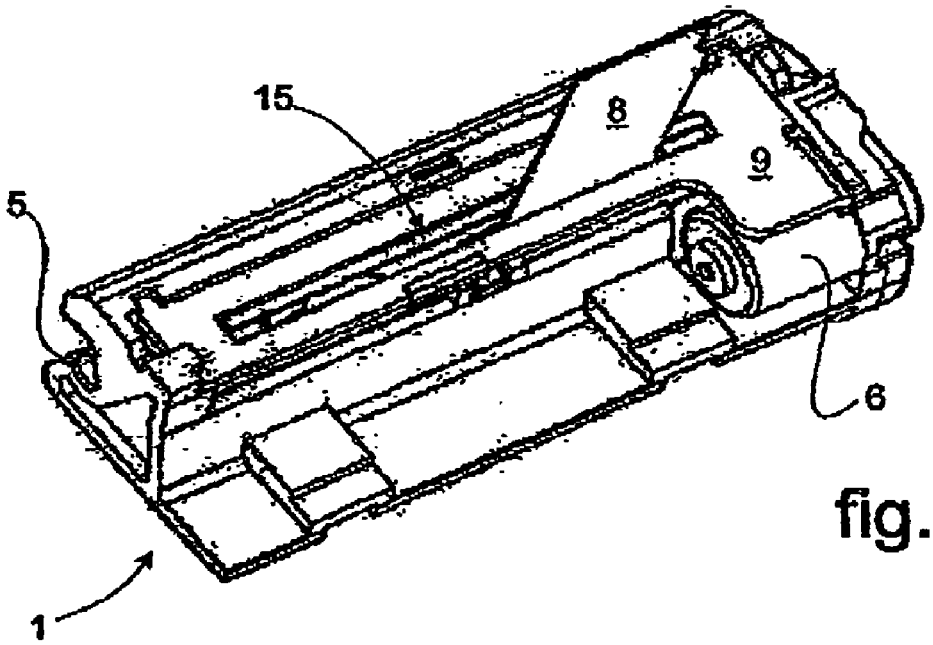
FIG. 4 is a partial view of the mechanism represented as assembled on FIG. 1.

It will be noted finally, more particularly on FIG. 2, that the rigidification plate 9 comprises an end wing 3 perpendicular to its general extension. This end wing 3 forms a wall of the cylindrical body of the motor 6, to which the wing 3 is welded. It will be observed that the rigidification plate 9, and the end wing 3 included therein, are advantageously formed by cutting/folding of a metal plate.

The invention claimed is:

1. A thermal printing mechanism, comprising:

a chassis made in plastic material housing driving means for a printable tape, a thermal printing head, means for contacting the tape against the printing head, and electronic means for controlling dynamic members of the mechanism, the tape driving means comprising a motor for driving a reserve roll of tape so that the tape circulates between the printing head and a support roller driven into rotation by the motor, the means for contacting the tape against the printing head comprising an elastic member for pushing the printing head towards the support roller, the chassis being equipped with a rigidification plate made in a metallic material extending substantially over its length, the chassis and the rigidification plate being separate components, wherein the rigidification plate is fixed to the chassis so that the rigidification plate is immobilized on the chassis in translation as well as in rotation about itself, and the motor is fixed to the rigidification plate so that the motor and the rigidification plate are capable of exchanging heat, the rigidification plate, as a metal plate, forming means for sinking the heat generated by the motor.

2. A mechanism according to claim 1, wherein the motor is welded to the rigidification plate.

3. A mechanism according to claim 2, wherein the rigidification plate comprises an end wing oriented transversally to its general extension, which forms a wall closing the cylindrical body of the motor member to which it is welded.

4. A mechanism according to claim 1, wherein the rigidification plate forms a supporting bracket of the elastic member pushing the printing head towards the support roller.

5. A mechanism according to claim 4, wherein the elastic member includes at least one leaf spring equipped with fastening means to the rigidification plate.

6. A mechanism according to claim 5, wherein the fastening means of the leaf spring to the rigidification plate are formed by lateral rails provided on the spring, inside which are inserted jointly the corresponding longitudinal edges of the rigidification plate, so that the leaf spring is connected to the rigidification plate by a sliding and fitting process.

7. A mechanism according to claim 5, wherein the elastic member forms as a locking means, for immobilising the rigidification plate on the chassis.

8. A mechanism according to claim 7, wherein the elastic member comprises an elastic fitting spoiler co-operating with a corresponding relief of the chassis, which forms a stop against the return of the spoiler to its natural position, in order to oppose the retraction of the rigidification plate.

9. A mechanism according to claim 5, wherein the leaf spring extends along the width of the mechanism, so as to adopt distant longitudinal bearing points against the printing head.

10. A mechanism according to claim 1, wherein the rigidification plate comprises transversally a longitudinal window for letting through a flexible connector that is part of the electronic controlling means.

11. A mechanism according to claim 10, wherein the printing head, the back-up roller, the elastic pushing member, the rigidification plate and the motor are in electrostatic contact after one another, so that the flexible connector is capable of transporting electrostatic charges towards a reference potential, placed beyond the mechanism.

12. A mechanism according to claim 1, wherein the chassis is obtained by moulding and comprises reliefs, produced by reserves during moulding, for fastening by fitting of the back-up roller, of the printing head, of the motor and of the rigidification plate.

13. A mechanism according to claim 1, wherein the chassis is obtained by molding.

14. A mechanism according to claim 1, wherein the printing head is fixed on the chassis.

15. A mechanism according to claim 14, wherein the roll of tape driving means is fixed to the chassis.

16. A mechanism according to claim 14, wherein the contacting means is fixed to the chassis.

* * * * *